United States Patent [19]

Baird

[11] 4,079,317

[45] Mar. 14, 1978

[54] SAFEGUARD SENTRY

[76] Inventor: William C. Baird, Meridian, Tex.

[21] Appl. No.: 575,874

[22] Filed: May 20, 1975

Related U.S. Application Data

[63] Continuation-in-part of Ser. No. 17,418, Mar. 9, 1970, abandoned, and a continuation of Ser. No. 379,171, Jul. 13, 1973, Pat. No. 3,921,074.

[51] Int. Cl.[2] ..... H04H 1/00

[52] U.S. Cl. ..... 325/302; 325/303; 325/466

[58] Field of Search ..... 340/224; 325/54, 64, 325/301, 302, 303, 304, 366, 392, 466; 343/200, 205, 225, 228

[56] References Cited

U.S. PATENT DOCUMENTS

| | | | |
|---|---|---|---|
| 2,330,241 | 9/1943 | Roberts | 325/303 X |
| 2,429,607 | 10/1947 | Capen | 343/200 |
| 2,684,402 | 7/1954 | Mountjoy | 325/302 X |

*Primary Examiner*—Benedict V. Safourek
*Attorney, Agent, or Firm*—Richards, Harris & Medlock

[57] ABSTRACT

A safeguard sentry for attachment to a radio or television receiving set comprises a receiver independent of the receiving set and responsive to a single predetermined emergency frequency. In one embodiment of the invention, the safeguard sentry is connected between the cut-off switch and the speaker of the receiving set, so that the safeguard sentry is energized when the receiving set is de-energized, and vice versa. In another embodiment of the invention, the safeguard sentry includes a switch which functions in one mode to couple a speaker to the safeguard sentry, and in another mode to connect operating power to the receiving set, to couple the speaker of the receiving set to the safeguard sentry, and to activate a visual signaling device. In still another embodiment of the invention, the receipt of an emergency signal by the safeguard sentry activates circuitry which mutes the audio output of the receiving set and simultaneously connects the safeguard sentry to the speaker of the receiving set. Receipt of the emergency signal may also be used to actuate an internal emergency tone signal generator and/or a visual emergency signal apparatus. In all instances in which an audible signal is generated, the safeguard sentry of the present invention produces an output having at least a predetermined volume.

5 Claims, 6 Drawing Figures

SAFEGUARD SENTRY

CROSS REFERENCE TO RELATED APPLICATION

This application is a continuation-in-part of co-pending application Ser. No. 17,418, filed Mar. 9th, 1970, for SAFEGUARD SENTRY SIGNAL DEVICE now abandoned, and a continuaton of 379,171 filed July 13, 1973 now Pat. No. 3921,074.

BACKGROUND AND SUMMARY OF THE INVENTION

This invention relates to an improved safeguard sentry, and more particularly to radio receiving apparatus adapted for attachment to a conventional radio or television receiving set to facilitate emergency communications.

The improved safeguard sentry of the present invention is for the purpose of obtaining immediate communication with the populace of the United States. The invention is therefore useful in warning of tornadoes, hurricanes, or other capriciousness of elements of nature; in warning of threat of or actual attack by foreign enemies; to advise of threats from public enemies; in deterrence of crime; and especially in the practicing of Civil Defense exercises.

In practice, the safegurad sentry would be placed on all newly manufactured radio and television set as a normal process during their manufacture. Apparatus incorporating the same operating principles will be available for installation on existing radio and television receivers.

The improved safeguard sentry is an electronic device consisting entirely of transistorized and compact circuitry. It is a transistorized radio receiver responsive to a predetermined emergency frequency, and will receive only this signal as broadcast or transmitted. When the emergency signal is received it is an electronic tone, beep, squeal, voice, or other signal that is received and amplified, and emitted from the speaker of the radio or television set to which it is applied, said signal having at least a predetermined volume.

In one embodiment the safeguard sentry is "power on" at all times when the radio or television is switched to the "off" position, thus requiring no conscious act to place it in operation. When the power switch of the radio or television is turned to "off" position, the safeguard sentry is alert and at work, thus assuring an available audience 24 hours a day. When the power switch of the radio or television is turned to "on" position, this cuts off the power to the safeguard sentry.

As an example, the proper authority may broadcast the emergency signal above-described, and the safeguard sentry immediately begins to emit the signal, which may be a "squeal". The owner of the radio or television set then turns the set "on" to receive the broadcast instructions from the authority, and through this act simultaneously turns off the squeal or signal. If no one is in "ear shot" of the signal it simply continues until the emergency signal ceases, and stops, neither disturbing nor advising anyone, and damaging or harming nothing.

The service which may be rendered by the safeguard sentry of the invention should be appreciated and in demand in the event of any form of enemy attack, such as the approach or imminence of assault by plane or missile, to serve in keeping an evenly informed public, to rally forces, and above all to help forestall panic, one of the most grave threats to be faced by "at home America".

In another embodiment the safeguard sentry includes a switch having two operating modes. In one mode the switch connnects the safeguard sentry to a speaker, which may comprise an internal speaker. In the other operating mode, the swtich of the safeguard sentry connects operating power to the receiving set. In this mode the switch also connects the output of the safeguard sentry to the speaker of the receiving set and enables a visual signaling apparatus. The visual signaling apparatus is actuated in response to the receipt of an emergency signal by the safeguard sentry, and functions to ward both deaf persons and persons in a high background noise environment. Regardless of the operating mode, the safeguard sentry includes a volume control which prevents the audible output of the apparatus from being reduced below a predetermined level.

In still another embodiment the safeguard sentry includes circuitry responsive to the receipt of an emergency signal by the safeguard sentry to mute the speaker of receiving set. This embodiment may further include apparatus for generating an internal tone signal and/or visual output in response to receipt of the emergency signal by the safeguard sentry. Regardless of whether the emergency signal is reproduced or an internal tone signal is generated, the audible portion of the warning signal provided by the third embodiment of the invention has at least a predetermined volume.

DESCRIPTION OF THE DRAWINGS

A more complete understanding of the invention may be had by referring to the following Detailed Description when taken in conjunction with the accompanying Drawings, wherein.

DETAILED DESCRIPTION

Figure 1:
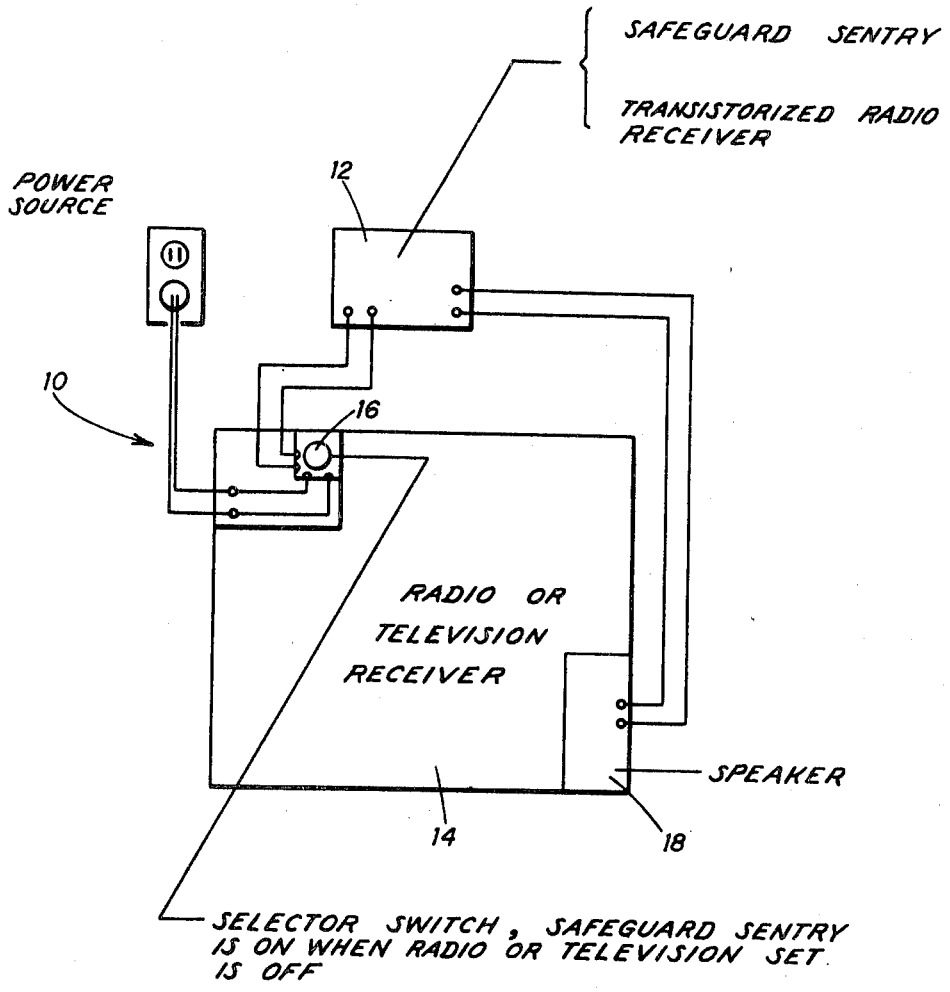
FIG. 1 is a somewhat diagrammatic illustration of a safeguard sentry incorporating a first embodiment of the invention.

Referring now to the Drawings, and particularly to FIG. 1 thereof, there is shown a safeguard sentry 10 incorporating a first embodiment of the invention. The safeguard sentry 10 comprises a radio receiver 12 responsive to a predetermined emergency frequency to emit a tone, beep, squeal or other signal and is utilized in conjunction with a conventional radio or television receiving set 14 having the usual cut-off switch 16 and speaker 18. The safeguard sentry 10 comprising the first embodiment of the invention may be constructed similarly to radio paging devices presently in commercial use, and preferably comprises a transistorized radio receiver turned to a predetermined frequency and characterized by extremely low current requirements. In accordance with the first embodiment, the safeguard sentry operates from the same power source as the receiving set which may comprise 115 volt, 60 hz line current, for example.

In accordance with the first embodiment of the invention, the safeguard sentry 10 is operatively connected to the cut-off switch 16 and the speaker 18 of the receiving set 14, it being understood that these two components are common both to the receiving set and to the safeguard sentry. The cut-off switch is operable as a selector or transfer switch, whereby either the receiving set 14 or the receiver 12 is continuously in operation depending on the position of the switch. Stated another way, the safeguard sentry is turned "on" at all times when the receiving set is turned "off", and the safeguard sentry is turned "off", at all times when the receiving set is turned "on". It will thus be understood that in accordance with the first embodiment of the invention the safeguard sentry operates "out of phase" with the radio or television receiving set. By this means whenever the receiving set is "off" the safeguard sentry is available to receive an emergency signal and to generate an audible reproduction thereof. This in turn advises persons in the vicinity of the receiving set to turn the receiving set "on", whereby emergency broadcast information is received by means of conventional broadcast communications. The safeguard sentry is turned "off" whenever the receiving set is "on" to prevent interference from the emergency signal with the emergency broadcost information, and to conserve power.

An important feature of the safeguard sentry 10 comprises the fact that whereas the receiver 12 may be provided with the suitable volume control, such control does not permit the output voltage produced by the receiver 12 in response to receipt of a signal at the emergency frequency to be reduced below a predetermined magnitude. This assures that the speaker 18 of the receiving set 14 will be actuated to produce an audible warning having at least a predetermined volume.

Figure 2:
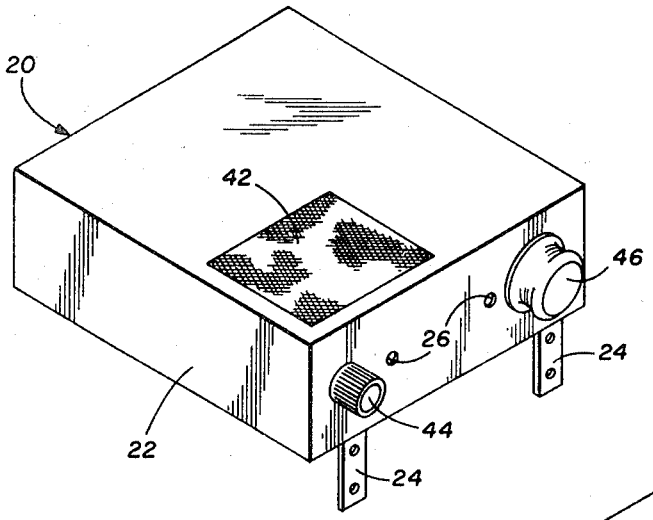
FIG. 2 is a front perspective view of a safeguard sentry incorporating a second embodiment of the invention.
Figure 3:
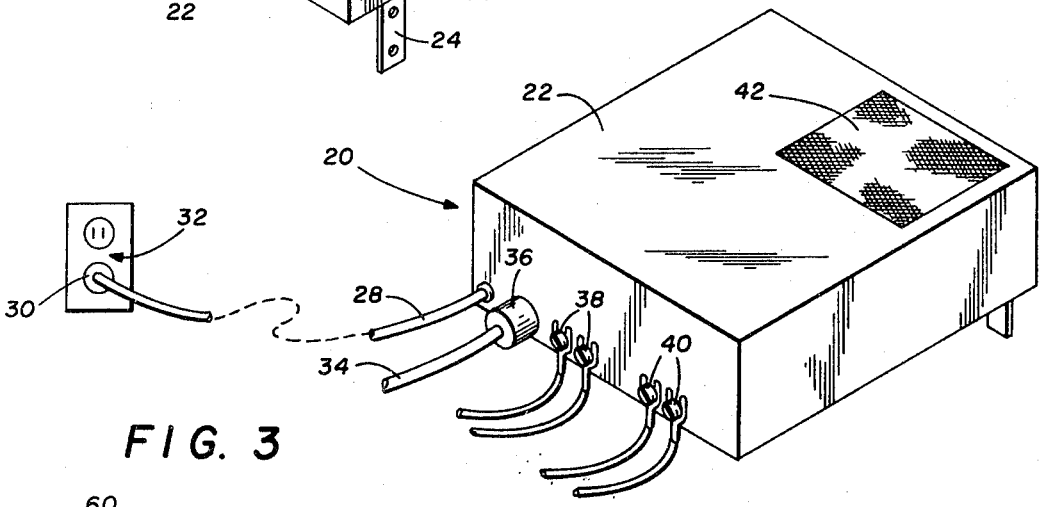
FIG. 3 is a rear perspective view of the embodiment illustrated in FIG. 2.

Referring now to FIGS. 2 and 3, a safeguard sentry 20 comprising a second embodiment of the invention is shown. The safeguard sentry 20 includes a cabinet 22 which is preferably formed from metal or one of the tough plastic materials so as to prevent access to the component parts of the safeguard sentry 20 by unauthorized persons. The cabinet 22 may be provided with conventional brackets 24 and/or conventional attachment holes 26, whereby the safeguard sentry 20 is secured to the cabinet of a radio or television receiving set, or in any other convenient location.

Referring particularly to FIG. 3, operating power for the safeguard sentry is supplied by means of a power cord 28 and a plug 30 which engages a conventional convenience outlet 32. The safeguard sentry 20 in turn supplies operting power to the receiving set by means of a cord 34. The cord 34 is connected to the cabinet 22 of the safeguard sentry 20 by means of a special connector 36 which prevents disengagement of the cord 34 from the cabinet 22. The safeguard sentry 20 further includes output jacks 38 for connection to the speaker of the receiving set and output jacks 40 for connection to the visual signaling apparatus.

Referring again to FIG. 2, the safeguard sentry 20 may be provided with an internal speaker 42. Regardless of whether the speaker 42 is used, a volume control 44 is provided in the safeguard sentry 20. The volume control 44 permits any desired increase in volume up to a predetermined maximum, but prevents reduction in volume below a predetermined minimum, thereby preventing disabling of the safeguard sentry 20 by means of the volume control 44. Th safeguard sentry 20 further includes a control switch 46.

The control switch 46 of the safeguard sentry 20 has two operating modes which are illustrated in FIGS. **4*a* and 4*b*, respectively. In one operating mode the switch 46 connects the output of the safeguard sentry 20 to the internal speaker 42. In this operating mode, an emergency signal received by the safeguard sentry 20** is reproduced directly thereby.

In the other operating mode, the switch 46 connects operating power from the safeguard sentry 20 to a radio or television receiving set 48. In this mode the switch 46 also connects the output of the safeguard sentry 20 to a speaker 50 mounted within the receiving set 48 and to a visual signaling apparatus 52. The visual signaling apparatus 52 preferably comprises a light emitting diode (LED) or similar electronic component having an extended operating life, and functions to provide an emergency warning signal to deaf persons and/or persons who may be situated in a high background noise environment.

It will thus be understood that the safeguard sentry 20 differs from the safeguard sentry 10 in that the safeguard sentry 20 is continuously in the "on" condition. When the control switch 46 of the safeguard sentry 20 is in one operating mode, the safeguard sentry 20 reproduces an emergency signal through the internal speaker 42. When the switch 46 is in the other operating mode, operating power is directed to the associated receiving set and the emergency signal is generated through the speaker of the receiving set. The safeguard sentry 20 is further adapted to provide a visual emergency signal.

Figure 5:
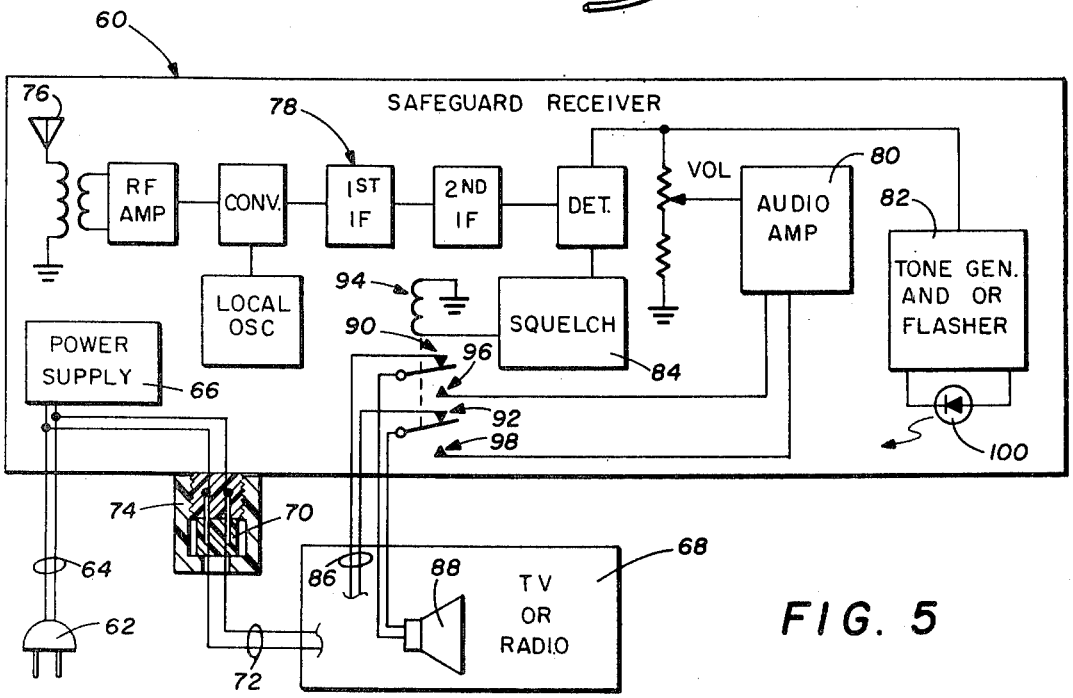
FIG. 5 is a schematic illustration of a safeguard sentry incorporating a third embodiment of the invention.
Figure 4A:
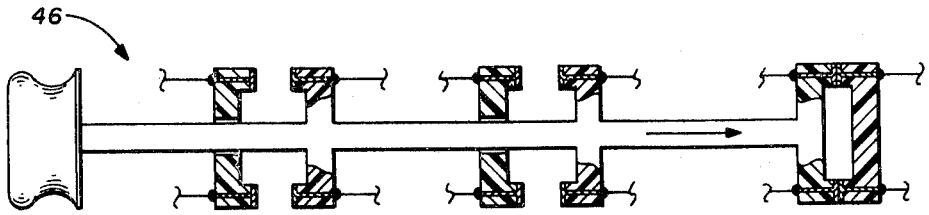
FIGS. 4*a* and 4*b* are illustrations of a switch utilized in the embodiment of the invention shown in FIGS. 2 and 3.
Figure 4B:
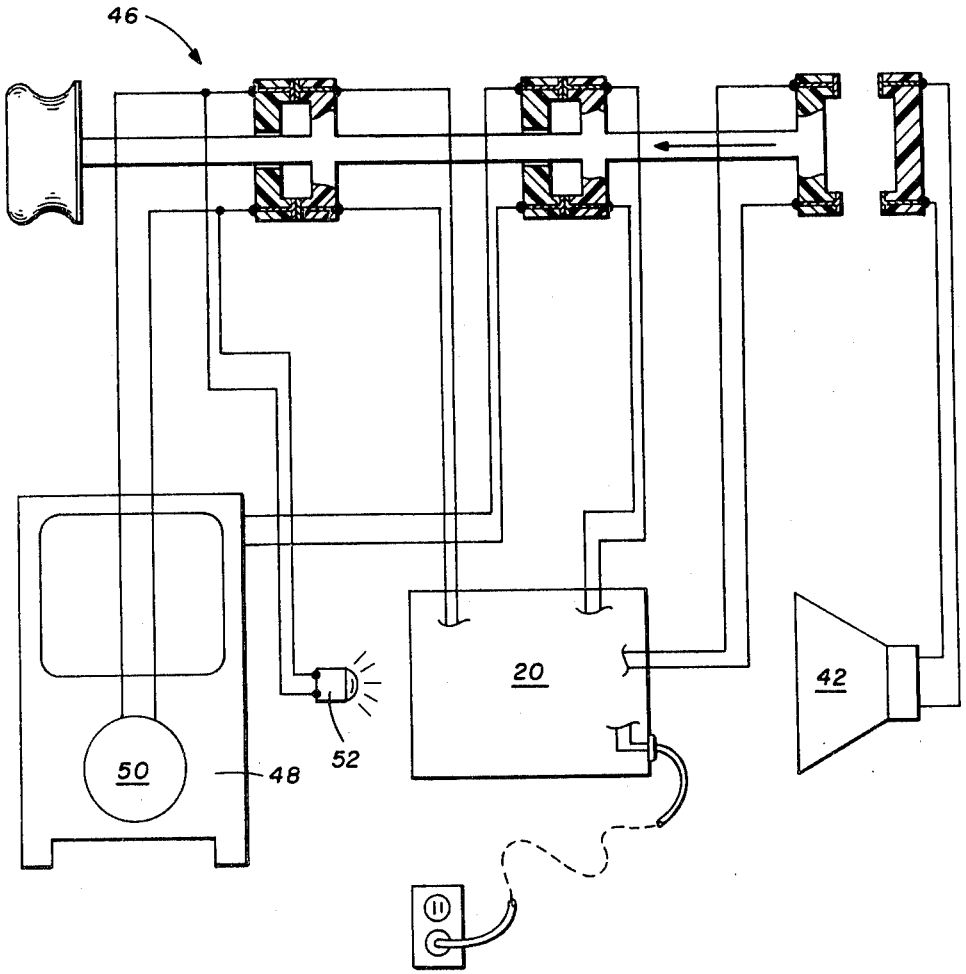

A safeguard sentry 60 comprising a third embodiment of the invention is illustrated in FIG. 5. Operating power for the safeguard sentry 60 is received from a conventional convenience outlet through plug 62 and a cord 64. The cord 64 extends to a conventional power supply circuit 66 which functions to supply operating power for the remaining components of the apparatus.

Operating power is also supplied from the safeguard sentry 60 to a radio or television receiving set 68. The receiving set 68 is connected to the safeguard sentry 60 by means of a plug 70 and a cord 72. The plug 70 is secured by a threaded fitting 74 which is so constructed that it cannot be disassembled without destroying the plug 70. By this means disengagement of the electrical connection from the receiving set 68 to the safeguard sentry 60 by unauthorized persons is prevented.

The safeguard sentry 60 includes an antenna 76 and a single conversion heterodyne circuit 78 for receiving an emergency signal. The output of the circuit 78 actuates an audio amplifier circuit 80 and a tone generator and/or flasher actuator circuit 82, thereby assuring operation of the safeguard sentry 60 in response to receipt of the emergency signal. The radio or television receiving set 68 includes conventional circuitry 86 for generating an audible output through a speaker 88. This circuitry is normally connected to the speaker 88 through normally closed contact pairs 90 and 92 located within the safeguard sentry 60. Upon receipt of an emergency signal, the safeguard sentry 60 by means of a squelch circuit 84, energizes a relay 94 which functions to open the contact pairs 90 and 92 and to close two normally open contact pairs 96 and 98. By this means the audible output from the receiving set 68 is immediately muted, and the speaker 88 of the receiving set is coupled to the audio amplifier circuitry 80 of the safeguard sentry. The emergency signal received by the safeguard sentry 60 is thereupon reproduced through the speaker 88 of the receiving set 68.

It will be understood that in addition to reproducing the emergency signal through the speaker 88, the receipt of the emergency signal by the safeguard 60 may be utilized to actuate the tone generator and/or flasher actuator circuit 82 to produce an internally generated audible alarm signal. The circuit 82 may also actuate apparatus 100 for producing a visual emergency signal. As has been explaind previously, the apparatus 100 preferably comprises a light emitting diode (LED) or similar electronic component designed to provide an extended service life.

The use of the safeguard sentry 60 produces a visual emergency signal which is primarily for the purpose of emergency communications with deaf persons and/or persons situated in a high background noise environment. To this end, the visual signal generating apparatus 100 may be located at a convenient point on the receiving set 68, or at any other location whereupon it will be readily visible to persons in the vicinity of the safeguard sentry 60. It is assumed that upon receiving the emergency signal by means of the apparatus 100, such persons would turn to the receiving set 68 or other apparatus to ascertain the precise nature of the emergency condition.

The safeguard sentry 60 also produces an audible emergency signal, either by reproducing the received emergency signal through the speaker 88 of the receiving set 68, or by means of the circuit 82, or both. Regardless of the mode used to produce the audible signal, the safeguard sentry 60 is preferably so designed that the volume of the audible signal cannot be reduced below a predetermined level. In the case of the circuit 82, a predetermined fixed volume can be used, if desired. In the case of the audio amplifier circuit 80, it is so constructed that the voltage output produced thereby has at least a predetermined magnitude, thereby assuring actuation of the speaker of the receiving set to produce an audible warning signal having at least a predetermined volume.

Those skilled in the art will apprecaite the fact that whereas three distinct embodiments of the safeguard sentry have been illustrated in the accompanying Drawings and described herein, the three embodiments incorporate various features in common, all of which are very important to the present invention. Perhaps most importantly, all of the embodiments contemplate the use of transistorized receiver circuitry responsive to a single, predetermined emergency frequency and entirely independent of the circuitry of the associated receiving set. This is important because it facilitates both optimization of the design of the emergency frequency receiving circuitry and optimization of the design of the circuitry of the broadcast receiving set. Moreover, the use of the entirely separate circuitry for the receiving set and the emergency frequency receiver does not increase the overall costs involved in the use of the invention due to the fact that by means of modern MOS and similar technologies, a single, uniform design emergency receiver can be manufactured at considerably less cost than would be incurred in incorporating emergency frequency receiver circuitry into the design of each new receiving set.

It will be further appreciated that various modifications can be made to the various specific embodiments of the safeguard sentry which have been illustrated in the Drawings. For example, the safeguard sentry 60 illustrated in FIG. 5 is readily adapted for use in automobiles or other vehicles. In such instances the safeguard sentry is modified for actuation by the electrical system of the vehicle, and for use in conjunction with the speaker of the ratio receiver of the vehicle. Moreover, the safeguard sentry is connected in series with the ignition switch of the vehicle so that the safeguard is "on" whenever the vehicle is in use, and is "off" whenever the vehicle is out of service. By this means the safeguard sentry is constantly available to provide emergency communications whenever an operator is situated in or around the vehicle, but does not drain power from the battery of the vehicle when the vehicle is out of service. Similar modifications can be made in the safeguard sentry to permit utilization of the invention in conjunction with portable radios, and the like.

From the foregoing it will be understood that the present invention relates to a safeguard sentry adapted to provide emergency communications with the citizenry of the United States. The use of the invention is highly advantageous in that the safeguard sentry comprises a transistorized radio receiver responsive to a particular emergency frequency and having very low power requirements. It will thus be understood that the safeguard sentry comprises a highly reliable, economical and thoroughly dependable emergency communication system. Moreover, the safeguard sentry of the present invention is adapted not only for incorporation into newly manufactured radio and television receiving sets, but also as an attachment to existing receiving sets.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. A safeguard sentry adapted for connection to a tunable receiving set having a speaker for producing an audible output, said tunable receiving set being tunable to any desired carrier frequency within its tuning range for providing ordinary programming audio output as said tunable receiving set speaker, comprising:

an emergency signal receiver means pretuned to a single predetermined emergency carrier frequency, said emergency signal receiver having radio-frequency and audio-frequency stages entirely distinct from those of said tunable receiving set for converting a received modulated emergency transmission at said predetermined carrier frequency into a corresponding audio-frequency output;

means for coupling the speaker of said tunable receiving set to the output of said emergency signal receiver means, said coupling means being operative to couple said tunable receiving set speaker to the output of said emergency signal receiver means during the reception of any such audio-frequency output irrespective of the frequency of the modulation of said emergency transmission signal and the corresponding frequency of such audio output of said emergency signal receiver; and manual switching means for alternatively energizing said emergency signal receiver means and said tunable receiving set such that said emergency signal receiver is energized whenever said tunable receiving set is is deenergized and vice versa.

2. A safeguard sentry adapted for connection to a tunable receiving set having a speaker for producing an audible output, said tunable receiving set being tunable to any desired carrier frequency within its tuning range for providing ordinary programming audio output at said tunable receiving set speaker, comprising:

an emergency signal receiver means having an internal speaker and being pretuned to a single predetermined emergency carrier frequency, said emergency signal receiver having radio-frequency , and audio-frequency stages entirely distinct from those of said tunable receiving set for converting a received modulated emergency transmission at said predetermined carrier frequency into a corresponding audio-frequency output;

manual switching means associated with said emergency signal receiver means for selectively energizing said tunable set while simultaneously continuously providing energy to said emergency signal receiver such that said emergency signal receiver is continuously on and is energized independent of said tunable receiving set; and said manual switching including means for coupling the speaker of said tunable receiving set or said emergency signal receiver speaker to the output of said emergency signal receiver means, said manual switching means being operative to couple either of said speakers to the output of said emergency signal receiver means during the reception of any such audio-frequency output irrespective of the frequency of the modulation of such emergency transmission signal and the corresponding frequency of such audio output of said emergency signal receiver.

3. A safeguard sentry adapted for connection to a tunable receiving set having a speaker for producing an audible output, said tunable receiving set being tunable to any desired carrier frequency within its tuning range for providing ordinary programming audio output at said speaker, comprising:

an emergency signal receiver means having an internal speaker and being pretuned to a single predetermined emergency carrier frequency, said emergency signal receiver having radio frequency and audio-frequency stages entirely distinct from those of said tunable receiving set for converting a received modulated emergency transmission at said predetermined carrier frequency into a corresponding audio-frequency output of at least a predetermined amplitude;

means for coupling the speaker of said tunable receiving set and said internal speaker of said emergency signal receiving set to the output of said emergency signal receiver means to produce an audible alarm signal of at least a predetermined volume, said coupling means being operative to couple said speakers to the output of said emergency signal receiver means during the reception of any such audio-frequency output irrespective of the frequency of the modulation of such emergency transmission signal and the corresponding frequency of such audio output of said emergency signal receiver; and means for automatically muting the audio output of said tunable receiving set upon the reception of a modulated emergency transmission by said emergency signal receiver.

4. The safeguard sentry of claim 3, further comprising visual signal means responsive to said emergency signal receiver means receiving a modulated emergency transmission at said predetermined carrier frequency for providing a visual alarm signal.

5. A safeguard sentry adapted for connecting to a tunable receiving set for producing an audible alarm signal upon receipt of a predetermined emergency frequency signal, comprising:

an emergency signal receiver means independent of said tunable receiving set and being pretuned to a single receiver having radio-frequency and audio-frequency stages entirely distinct from those of such tunable receiving set for converting a received modulated emergency transmission at said predetermined carrier frequency into a corresponding audio-frequency output of at least a predetermined amplitude; and means for coupling the speaker of said tunable receiving set to the output of said emergency signal receiver means to produce an audible alarm signal of at least a predetermined volume, said coupling means being operative to couple said speaker to the output of said emergency signal receiver means during the reception of any such audio-frequency output irrespective of the frequency of modulation of said emergency transmission signal and the corresponding frequency of said audio output of said emergency signal receiver.

* * * * *

UNITED STATES PATENT AND TRADEMARK OFFICE

CERTIFICATE OF CORRECTION

PATENT NO. : 4,079,317

DATED : March 14, 1978

INVENTOR(S) : William C. Baird

It is certified that error appears in the above-identified patent and that said Letters Patent are hereby corrected as shown below:

Column 1, line 19, "immediate communication" should be --immediate emergency communication--.
line 29, "set" should be --sets--.
line 39, "it is an" should be --it is as an--.
Column 2, line 65, "turned" should be --tuned--.
Column 3, line 54, "operting" should be --operating--.
Column 4, line 2, "Th" should be --The--.
Column 5, line 11, "explaind" should be --explained--.
line 62, "emergency receiver" should be --emergency frequency receiver--.
Column 6, line 6, "ratio" should be --radio--.
line 46, "as" should be --at--.

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*